United States Patent [19]

Imai

[11] Patent Number: 4,944,690

[45] Date of Patent: Jul. 31, 1990

[54] ELECTRICAL CONNECTOR FOR FLAT ELECTRICAL CABLES

[75] Inventor: Akira Imai, Kanagawa, Japan

[73] Assignee: AMP Incorporated, Harrisburg, Pa.

[21] Appl. No.: 272,178

[22] Filed: Nov. 16, 1988

[30] Foreign Application Priority Data

Jan. 14, 1988 [JP] Japan ..... 63-3778

[51] Int. Cl.[5] ..... H01R 9/07

[52] U.S. Cl. ..... 439/492

[58] Field of Search ..... 439/492–499

[56] References Cited

U.S. PATENT DOCUMENTS

| | | | |
|---|---|---|---|
| 4,172,626 | 10/1979 | Olsson . | |
| 4,252,392 | 2/1981 | Whiteman, Jr. . | |
| 4,314,312 | 2/1982 | Donmoyer et al. . | |
| 4,334,728 | 6/1982 | Reynolds et al. . | |
| 4,630,874 | 12/1986 | Renn et al. | 439/492 |
| 4,634,195 | 1/1987 | Shoemaker . | |
| 4,639,063 | 1/1987 | Mueller . | |
| 4,640,562 | 2/1987 | Shoemaker . | |
| 4,718,859 | 1/1988 | Gardner | 439/493 |

OTHER PUBLICATIONS

AMP Catalog 86-718 Issued 8-88, "AMP FPC Connectors", pp. 1–4.

*Primary Examiner*—Joseph H. McGlynn
*Attorney, Agent, or Firm*—Bruce J. Wolstoncroft; Adrian J. LaRue

[57] ABSTRACT

An electrical connector for electrically connecting electrical conductors (2*b*) of a flat electrical cable (2) to electrical conductive areas of a circuit board comprises a dielectric housing (3) having electrical contacts (5) secured in the housing with spring contact sections (5*b*) located within the housing and terminating sections (5*a*) extending outwardly from the housing. A cover member (4) is movably mounted on the housing (3) from an open position to permit a section (2*a*) of the cable (2) to be positioned along the housing (3) and a closed position whereby the cable section (2*a*) is forced by the cover member (4) against the spring contact sections (5*b*) so that the contact sections (5*b*) electrically engage the respective electrical conductors (2*b*). Securing members (6) of the cover member (4) clampingly engage the cable section (2*a*) between the securing members (6) and the housing (3) when the cover member (4) is in the closed position thereby securing the cable between the housing (3) and cover member (4).

13 Claims, 4 Drawing Sheets

ELECTRICAL CONNECTOR FOR FLAT ELECTRICAL CABLES

FIELD OF THE INVENTION

This invention relates to an electrical connector for flat flexible or flexible printed electrical cable to electrically connect the cable to a printed circuit board.

BACKGROUND OF THE INVENTION

An electrical connector is disclosed in U. S. Patent Application Ser. No. 182,697 filed April 18, 1988 for electrically connecting electrical conductors of a flat flexible or flexible printed electrical cable to conductive paths of a printed circuit board which involves inserting an end of the cable within the connector and clamping the cable between a cover member and a dielectric housing so that electrical contacts in the housing are electrically connected with exposed conductor ends or sections of the conductors of the cable.

The cable would easily slip out of the connector, because it was not securely clamped in one version of the connector. In another version of the connector, holes would be formed in the cable and mated with projections in the connector housing which would secure the cable in the connector. This required a special tool to make the holes in the cable and the cable would be weakened. A further version of the connector was to force the cover member with a depressed section that increased the contact pressure between the contacts and the cable conductors. In the case of a connector with few electrical contacts, the retention pressure between the contacts and the cable conductors was insufficient to effectively retain the cable in the connector. Then a connector with a large number of contacts was used, the contact pressure of the contacts on the cable conductors at the outer sides of the cable was higher than the center contacts on the center cable conductors thereby causing the connection between the outer contacts and center conductors to be poor resulting in reduced connector performance.

The objective of the present invention is to resolve the above-identified problems and provide an electrical connector for flat flexible or flexible printed electrical cables that is simple in structure and retains the flat cable securely in the connector.

SUMMARY OF THE INVENTION

An electrical connector for electrically connecting electrical conductors of a flat electrical cable of the flat flexible or flexible printed variety to electrical conductive areas of a circuit board comprises a dielectric housing having electrical contacts secured to the housing with spring contact sections and terminating sections. The contact sections are disposed within the housing for electrical connection with respective electrical conductors of the flat cable when a section of the flat cable is positioned along the housing and the terminating sections extend outwardly from the housing for electrical connection to respective conductive areas of the circuit board. A cover member is movably mounted on the housing from an open position to permit the cable section to be positioned along the housing and a closed position whereby the cable section is forced by the cover member against the contact sections so that the contact sections electrically engage the respective conductors. Securing members of the cover member clampingly engage the cable section between the securing members and the housing when the cover member is in the closed position thereby securing the cable within the housing.

A reinforcing member is provided on the section of the flat cable that is positioned in the connector which is engaged by the securing members on the cover member and the reinforcing member assists in distributing the pressure being applied to the cable by the cover member as well as protecting the cable in this area.

BRIEF DESCRIPTION OF THE DRAWINGS

The invention, together with objects and advantages thereof, is best understood by way of example with reference to the following description in conjunction with the accompanying drawings. .

DETAILED DESCRIPTION OF THE INVENTION

Electrical connector 1, as shown in FIGS. 1–7, includes a dielectric housing 3 of a suitable dielectric material with spaced electrical contacts 5 therein which are molded in position during the molding of the housing. Contacts 5 have terminating sections **5*a* extending outwardly from the front and rear surfaces of housing 3 and spring contact sections 5*b* disposed within an opening 3*b* of the housing. The terminating sections 5*a* are in the form for surface mounting onto a circuit board (not shown) with the front terminating sections being soldered to metal areas on the circuit board to secure the connector thereonto while the rear terminating sections as part of the contact sections are soldered to conductive areas of the circuit board. Terminating sections 5*a*** can be also in the form of posts for disposition in holes in the circuit board.

Figure 1:
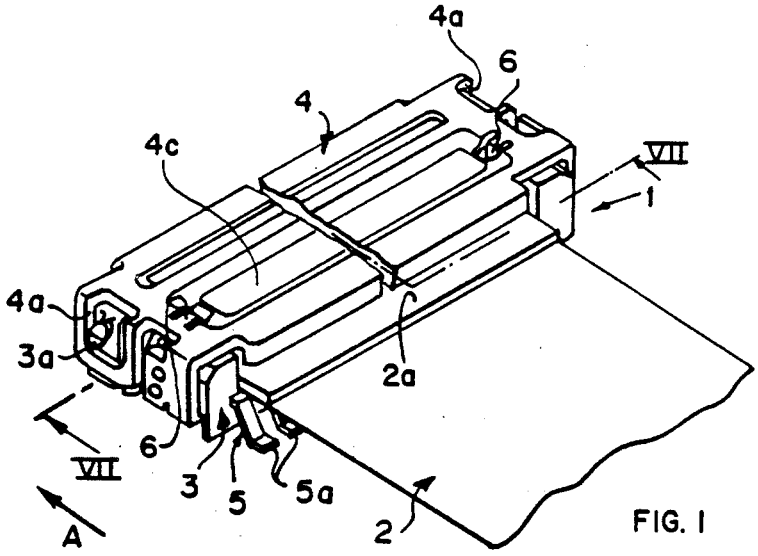
FIG. 1 is a perspective view of an electrical connector electrically connected to a flat cable.
Figure 5:
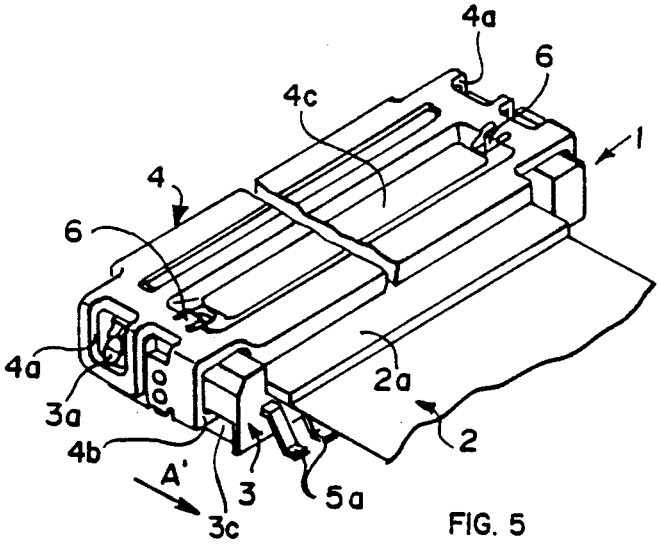
FIG. 5 is a view similar to FIG. 1 showing the cover member prior to being moved to a latched position.
Figure 6:
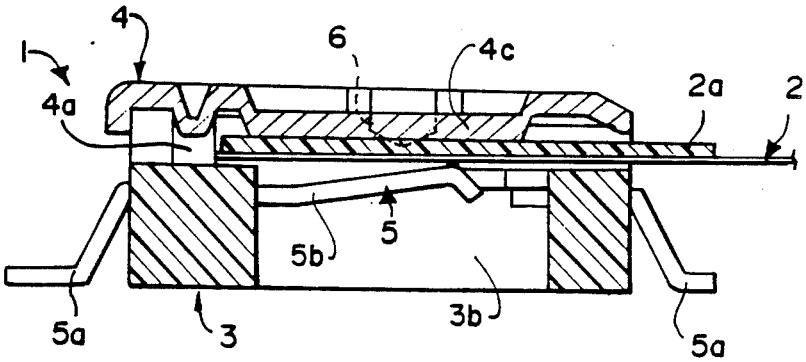
FIG. 6 is a cross-sectional view of FIG. 1.

A movable cover member 4 is stamped from a suitable metal and is pivotally mounted on housing 3 via pivot projections **3*a* extending outwardly from the sides of the housing at the rear through openings 4*a* in the rear sides of the cover member 4. Openings 4*a* are large enough to enable the cover member 4 to move along the housing with the outer inside surfaces of the cover member sliding along the upper surfaces of the sides of housing 3 until latching projections 4*b* of the cover member 4 (FIG. 5) engage surfaces 3*c* of housing 3 thereby latching the cover member 4 in position on housing 3 as shown in FIGS. 1 and 6. Cover member 4 also has an inwardly-directed depressed section 4*c* and securing members 6**.

Figure 8:
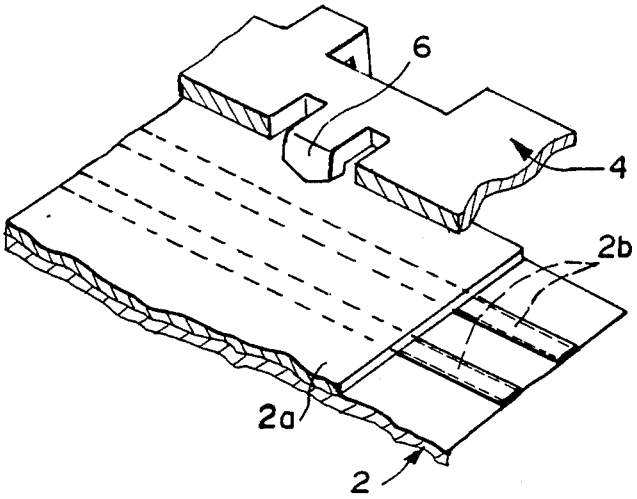
FIG. 8 is a part cross-sectional view in perspective showing a reinforcing member on the cable and a securing member of the cover member.

Flat cable 2 is a conventional cable that can be of the flat flexible or flexible printed type which has spaced electrical conductors 2*b* (FIG. 8) on one surface. A stiffly flexible reinforcing member 2*a* of dielectric material is secured onto the section of cable 2 opposite conductors 2*b* that is to be positioned in connector 1.

Figure 2:
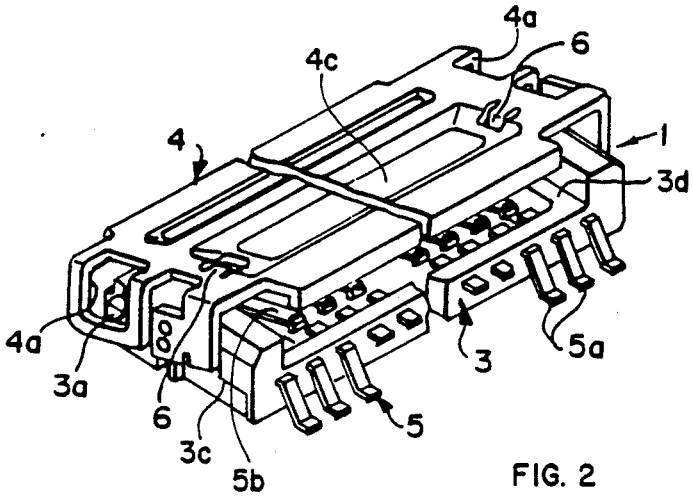
FIG. 2 is a perspective view of the electrical connector with a cover member in an open position.
Figure 3:
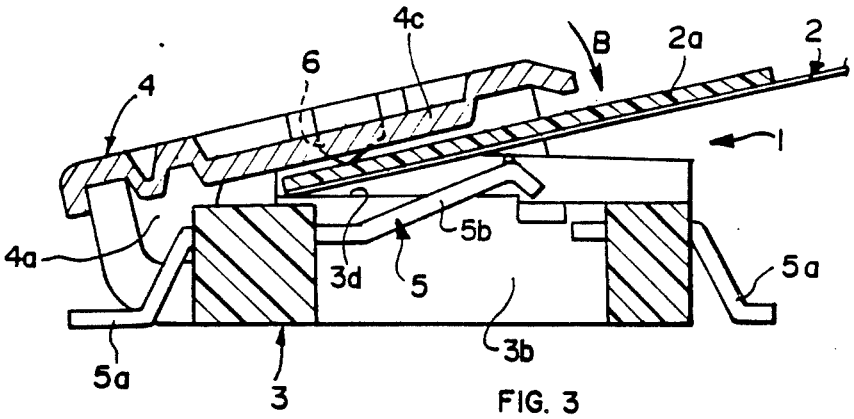
FIG. 3 is a cross-sectional view of FIG. 2 with a section of the flat cable positioned within the connector.
Figure 4:
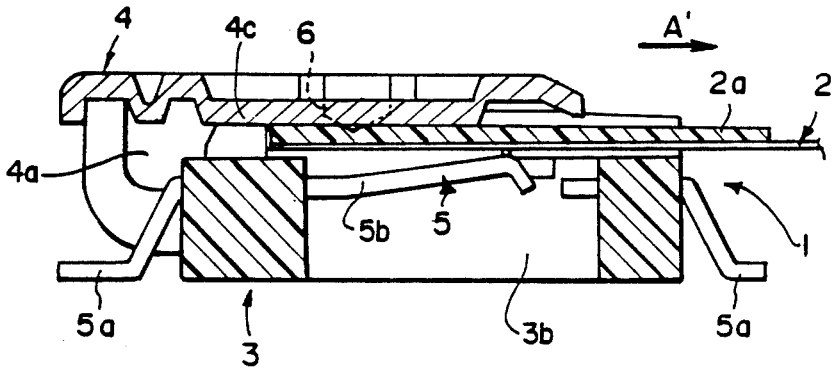
FIG. 4 is a view similar to FIG. 3 showing the cover member in a closed position with the contact sections electrically engaging the electrical conductors of the flat cable.

To connect flat cable 2 to connector 1, cover member 4 is moved in the direction of arrow A, FIG. 1, which causes the cover member to be unlatched and pivoted to an open position as shown in FIGS. 2 and 3 by the spring contact sections 5*b*. The reinforced section of the cable 2 is positioned within the connector 1 between the housing 3 and the cover member 4, as shown in FIG. 3. Cover member 4 is then moved to a closed position in the direction of arrow B, FIG. 3, with depressed section 4*c* and securing members 6 of the cover member 4 engaging reinforcing member 2*a* thereby forcing the conductors 2*b* into electrical engagement with the respective spring contact sections 5*b*. Depressed section 4*c* increases the contact pressure between conductors 2*b* and spring contact sections 5*b*. The cover member 4 is then slid in the direction of arrow A', FIGS. 4, 5, whereby depressed section 4*c* and securing members 6 slide along the reinforcing member 2*a* and projections 4*b* engage surfaces 3*c* thereby latching the cover member 4 in the closed position as shown in FIGS. 1 and 5 and clamping the reinforced section of the cable between the cover member and the housing.

Figure 7:
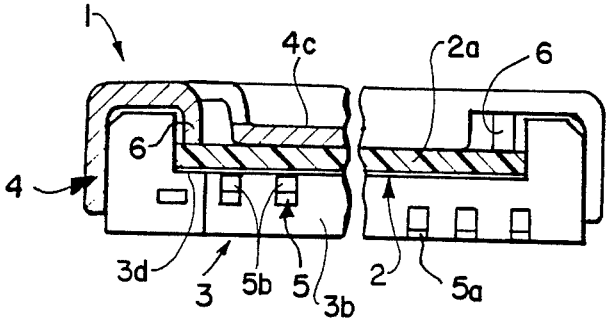
FIG. 7 is a cross-sectional view taken along line VII—VII of FIG. 1.

Securing members 6 have pointed ends that dig into the reinforcing member 2*a* thereby securing the cable 2 in the connector 1 by clamping the outer parts of the cable and reinforcing member adjacent the edges between the pointed ends of the securing members 6 and surfaces 3*d* of housing 3 within opening 3*b* which are disposed opposite securing member 6, as shown in FIG. 7. Thus, the cable is clampingly secured in connector 1 between the surfaces 3*d* of housing 3 and the securing members 6 of cover member 4 with the depressed section 4*c* of cover member 4 maintaining the conductors 2*b* of the flat cable 2 in electrical engagement with the spring contact sections 5*b*. Securing members 6 are located outwardly from the ends of depressed section 4*c*.

The advantages of the connector of this invention are the following: The connector is of simple construction; no forming of the cable needs to be done such as focusing holes in it thereby reducing manufacturing costs; the cable is effectively secured in the connector with no damage to the connector or cable as a result of the clamping pressures effected by the securing members; the connector is suitable for flat flexible cables which cannot have holes formed therein; imperfect electrical engagement between the cable conductors and the spring contact sections is eliminated thereby guaranteeing high performance of the connector.

I claim:

1. An electrical connector for electrically connecting electrical conductors of a flat cable to a circuit board, the connector comprising:

a dielectric housing having electrical contact members secured therein at spaced intervals corresponding to the spacing of the electrical conductors of the flat cable, said contact members having spring contact sections being within said housing for making electrical connection to the conductors of the flat cable and leg sections extending outwardly from said housing for electrical connection to the conductors of the circuit board;

a cover member pivotally and slidably mounted on said housing for pivoting said cover member between an open position to allow insertion of the flat cable and a closed position to be held in that position by sliding said cover member; and securing members on said cover member extending toward said housing for clampingly engaging the inserted flat cable in the closed position of said cover member.

2. An electrical connector of claim 1, wherein the leg sections of said electrical contact members are surface mountable on the circuit board.

3. An electrical connector of claim 1, wherein said cover member is made of a formed metal plate.

4. An electrical connector of claim 1, wherein said cover member is pivoted at the sides closer to the side mounting said electrical contact members.

5. An electrical connector for electrically connecting electrical conductors of a flat cable to a circuit board, comprising:

a dielectric housing having electrical contact members secured therein at spaced intervals corresponding to the spacing of the electrical conductors of the flat cable, said contact members having spring contact sections and leg sections, said spring contact sections being within said housing for electrical connection to exposed conductors of the flat cable when a section of the flat cable is positioned within the housing while said leg sections extend outwardly from said housing for electrical connection to conductive areas of the circuit board;

a cover member;

mounting means on said housing and said cover member enabling said cover member to pivot between an open position so that the section of the flat cable can be positioned between said housing and said cover member and a closed position with the exposed conductors in electrical engagement with the spring contact sections whereafter said cover member is slidable along said housing to a latching position;

latch means on the cover member and the housing for latching the cover member in the closed position; and securing members of said cover member clampingly engaging the cable section between the securing members and the housing when the cover member is in the closed position thereby securing the cable between the housing and cover member.

6. An electrical connector as claimed in claim 5, wherein said mounting means comprise pivot projections on said housing and said cover member ha rectangular openings in which said pivot projections are disposed.

7. An electrical connector as claimed in claim 5, wherein said latch means comprise inwardly-directed projections on said cover member that engage surfaces of said housing.

8. An electrical connector as claimed in claim 5, wherein said leg sections extend outwardly from a rear surface of said housing and further leg sections extend outwardly from a front surface of said housing, the leg sections that extend outwardly from the rear surface are connectable to the conductive areas of the circuit board whereas the further leg sections extending outwardly from the front surface are connectable to metal areas on the circuit board thereby securing the connector to the circuit board.

9. An electrical connector as claimed in claim 5, wherein the housing has surfaces disposed opposite the securing members along which outer parts of the cable section extend so that the cable section is clamped between the surfaces and the securing members when the cover member is in the closed position.

10. An electrical connector as claimed in claim 5, wherein the securing members have pointed ends that dig into the cable section.

11. An electrical connector as claimed in claim 5, wherein the cover member has a depressed section for engagement with the cable section to increase the contact pressure between the conductors and the spring contact sections.

12. An electrical connector as claimed in claim 11, wherein the securing members are located outwardly from the depressed section so that they clampingly engage the cable section adjacent the edges thereof between the securing members and surfaces of the housing.

13. A low profile electrical connector for electrically connecting electrical conductors of a flat cable to a circuit board, comprising:

a generally rectangular, relatively thin dielectric housing having an opening at a substantially center portion;

a plurality of electrical contact members mounted in one side of said dielectric housing at the spacing of the electrical conductors of the flat cable, said electrical contact members having resilient contact sections extending into said opening and leg sections extending outwardly to be electrically connected to conductors on the circuit board;

a plurality of mounting legs mounted on the opposite side of said dielectric housing for securing to metal areas on the circuit board; and a cover member pivotally mounted on the sides of said dielectric housing perpendicular to the two sides to be positioned between open and closed positions, said cover member having a depressed portion and a plurality of securing members for respectively pressing the flat cable onto said electrical contact members and biting the flat cable in the closed position of said cover member.

* * * * *